US006065250A

United States Patent [19]

McCabe

[11] Patent Number: 6,065,250

[45] Date of Patent: May 23, 2000

[54] REINFORCED HANDRAIL

[76] Inventor: Bernard P. McCabe, 1330 10th St., Clarkston, Wash. 99403

[21] Appl. No.: 09/240,820

[22] Filed: Feb. 1, 1999

[51] Int. Cl.[7] ..... E04F 11/18

[52] U.S. Cl. ..... 52/27; 52/317; 248/205.3; 403/292; 403/282; 411/373

[58] Field of Search ..... 52/317; 248/205, 248/205.3, 205.6; 285/179; 403/282; 411/372, 373

[56] References Cited

U.S. PATENT DOCUMENTS

| | | | |
|---|---|---|---|
| 1,152,974 | 9/1915 | Rice | 285/179 |
| 1,594,714 | 8/1926 | Eustis . | |
| 2,653,579 | 9/1953 | Sanders et al. . | |
| 3,384,333 | 5/1968 | Bohlman et al. . | |
| 3,781,730 | 12/1973 | Salners | 248/205 |
| 4,088,414 | 5/1978 | Fallein | 403/282 |
| 4,477,059 | 10/1984 | Willis . | |
| 4,524,506 | 6/1985 | Wilke . | |
| 4,658,556 | 4/1987 | Jenkins | 52/317 |
| 5,127,131 | 7/1992 | Corrigan et al. . | |
| 5,189,857 | 3/1993 | Herren et al. | 52/317 |
| 5,193,786 | 3/1993 | Guenther . | |
| 5,249,400 | 10/1993 | Turner . | |
| 5,396,740 | 3/1995 | Bocchi . | |
| 5,615,968 | 4/1997 | Verenski et al. . | |
| 5,653,564 | 8/1997 | Nakamura | 411/373 |
| 5,909,758 | 6/1999 | Kitamura | 248/205.3 |

FOREIGN PATENT DOCUMENTS

| | | | |
|---|---|---|---|
| 348-586 | 1/1990 | European Pat. Off. | 248/205.3 |
| 2725-921 | 12/1978 | Germany | 403/292 |

*Primary Examiner*—Carl D. Friedman
*Assistant Examiner*—Kevin McDermott
*Attorney, Agent, or Firm*—David S. Thompson

[57] ABSTRACT

A reinforced handrail provides two to four brackets attached to wallboard in a linear manner. Two brackets are end brackets, and there may be one or more center brackets. The wallboard is supported by vertically oriented 2×4 studs at spaced intervals, and is typically covered by tile, fiberglass or other protective surface. The wallboard and 2×4 studs may be strengthened by 2×6 reinforcements which are carried between adjacent 2×4 studs. Each bracket carries a short stand-off which is oriented perpendicularly to the wallboard. The stand-offs carried by end brackets in turn carry elbows. The stand-offs carried by center brackets carry rail supports. A handrail is carried by the elbows and rail supports. Where the handrail is formed from first and second segments, a stiffener insert may be used to increase the rigidity between the segments.

1 Claim, 3 Drawing Sheets

REINFORCED HANDRAIL

CROSS-REFERENCES

There are no applications related to this application filed in this or any foreign country.

BACKGROUND OF THE INVENTION

A number of handrails are known, for use in bathrooms, hallways and other areas where extra support or stabilization may be needed. Individually, the known handrails provide a wide variety of structures which provide support and allow attachment to a wall or other supporting structure. However, while a wide variety of issues have been addressed, including attachment, reinforcement and support, the known handrails have so far failed to provide the correct mix of structures which cooperate effectively to provide a handrail that is rigid, easily installed and cost-effective.

An additional problem found with known handrails is that the fasteners and other hardware used to install the handrail is subjected to a harsh environment, including frequent application of water. Adhesives are typically used in such an environment for such accessories as soap dishes, which may be adhered to the tile surface. However, where a great deal of weight must be borne, adhesives are not safe. This leaves unresolved the question of how to fasten a handrail, and at the same time protect the fastening hardware used.

SUMMARY OF INVENTION

The reinforced handrail of the present invention provides some or all of the following structures:

(A) A plurality of brackets are rigidly connected to wallboard or other supporting surface in a linear array. In a preferred version, three such brackets are installed, representing two end and one center bracket. Each bracket provides a cylindrical body having a first end closed by an end wall and an open second end. The end wall provides an outside surface having an adhesive covering which is adhered to the wallboard. The open second end allows attachment of a short standoff tube. A plurality of flanges are radially directed from the cylindrical body flush with the end wall, and are adjacent to the wall or other supporting surface. Each flange defines a fastener hole and provides two reinforcing ribs. In a preferred embodiment, three flanges are radially spaced in an even manner and allow attachment of the bracket to the wall by means of wood screws, Molly(™) type fasteners or other fastening means. A cover having a base and a lid encloses the head of the fastening means, thereby protecting it from water and providing a more esthetic appearance.

(B) A stand-off is carried within the cylindrical body of each bracket, and extends perpendicularly from the supporting wall. A preferred version of the stand-off is 2 to 4 inches in length and is incrementally smaller in diameter than the cylindrical body of the bracket, and is typically attached by glue or other fastening means.

(C) First and second elbows, carried by stand-offs supported by the two end brackets, each provide a hollow body having first and second cylindrical ends oriented at right angles. The inside diameter of the first cylindrical end of the elbow is typically incrementally larger than the stand-off, and is attached by glue or other fastening means.

(D) A handrail having first and second ends is carried between the second cylindrical ends of the elbows, and is oriented parallel to the wall. Where the handrail includes similar first and second segments, a stiffener insert is carried within the handrail adjacent to both the first and the second segments.

(E) A rail support is attached to a middle portion of the handrail, and provides additional support and rigidity. The rail support provides a sliding cylindrical body portion adjustably located on the handrail and a perpendicular cylindrical body portion carried by the stand-off carried by the center bracket.

(F) A number of 2×6 reinforcements are provided between adjacent 2×4 studs. The 2×6 reinforcements strengthen the 2×4 studs and also the wallboard carried by the 2×4 studs. Where desired, the wallboard and the brackets may be attached to the 2×6 reinforcements.

It is therefore a primary advantage of the present invention to provide a novel reinforced handrail that is economically manufactured, easily installed and reliable in use.

Another advantage of the present invention is to provide a novel reinforced handrail having a plurality of brackets that may be installed on tile or wallboard by the use of both adhesive means and wood screws or Molly(™) fasteners, and wherein the wallboard is reinforced by 2×6 reinforcements carried between the 2×4 studs supporting the wallboard.

A still further advantage of the present invention is to provide a reinforced handrail that provides a stiffener insert that is carried within the handrail to reinforce the handrail when the handrail is made from two segments.

DESCRIPTION OF THE DRAWINGS

These and other features, aspects, and advantages of the present invention will become better understood with regard to the following description, appended claims, and accompanying drawings where:

DESCRIPTION OF THE INVENTION

Figure 1:
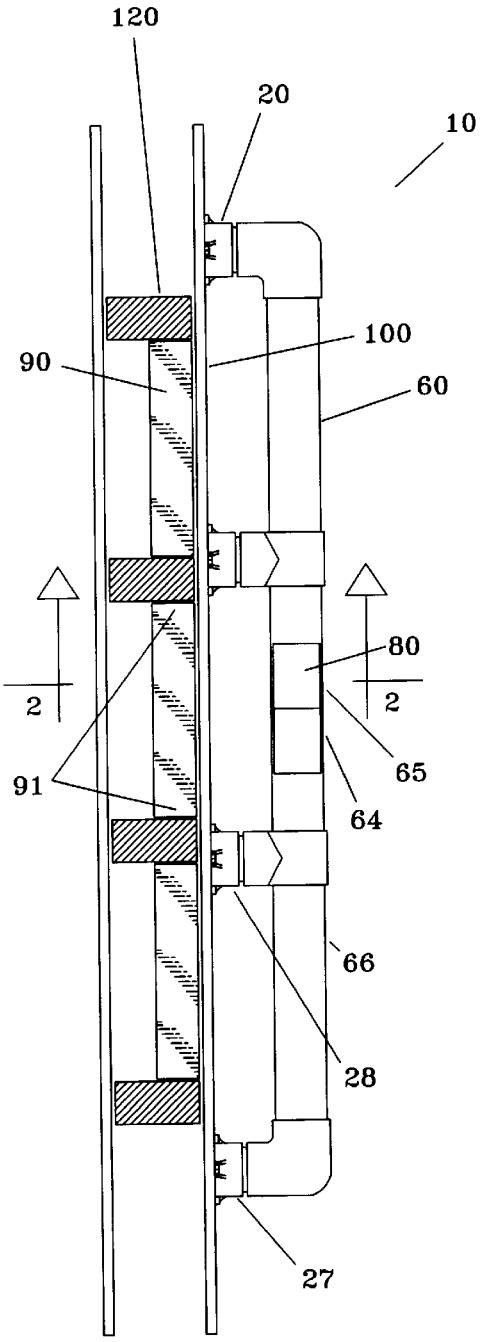
FIG. 1 is a top cross-sectional view of a version of the reinforced handrail having two end brackets and two center brackets and associated rail supports.

Referring generally to FIGS. 1 through 8, a preferred version of a reinforced handrail constructed in accordance with the principles of the invention is seen. The reinforced handrail 10 typically provides two to four brackets 20 attached to wallboard 100 in a linear manner. Two brackets are end brackets, and there may be one or more center brackets. The brackets are held to the wall with fasteners which are adapted to attach to the wallboard. The head of the fasteners are enclosed and protected by a cover which also improves esthetics. The wallboard is supported by vertically oriented 2×4 studs 120 at spaced intervals, and is typically covered by tile, fiberglass or other protective surface. The wallboard and 2×4 studs may be strengthened by 2×6 reinforcements 90 which are carried between adjacent 2×4 studs. Each bracket 20 carries a short stand-off 40 which is oriented perpendicularly to the wallboard. The stand-offs carried by end brackets in turn carry elbows 50. The stand-offs carried by center brackets carry rail supports 70. A handrail 60 is carried by the elbows and rail supports. Where the handrail is formed from first and second segments, a stiffener insert 80 may be used to increase the rigidity between the segments.

Figure 5:
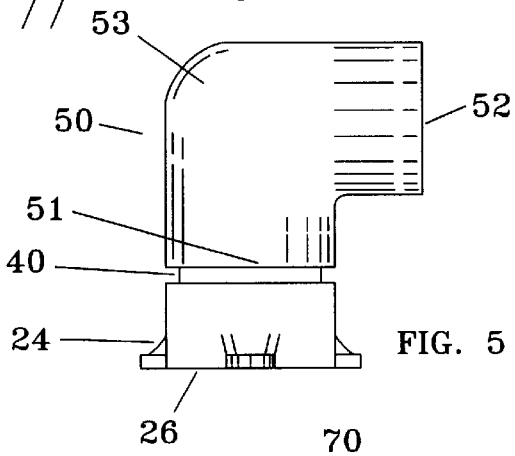
FIG. 5 is an enlarged view of the elbow and bracket of FIG. 4, taken from a perspective perpendicular to that of FIG. 4.
Figure 6:
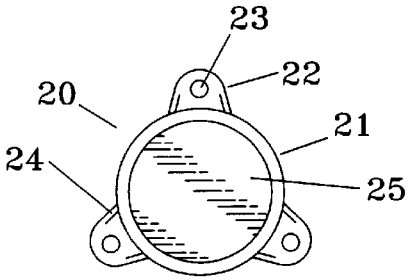
FIG. 6 is a view of a bracket having the stand-off and elbow removed, taken from the perspective of FIG. 4.
Figure 7:
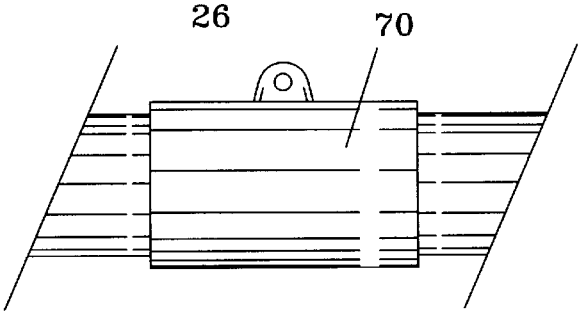
FIG. 7 is an enlarged view of the bracket and rail support from the perspective of FIG. 3.
Figure 8:
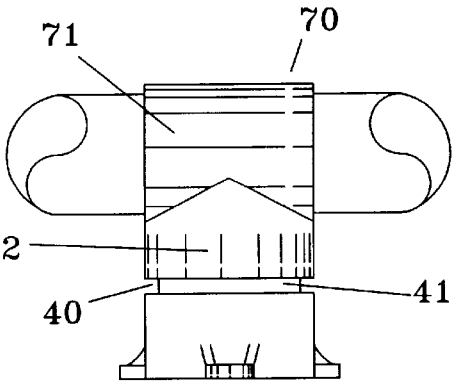
FIG. 8 is a view of the bracket, stand-off, rail support and handrail, from a perspective perpendicular to that of FIG. 7.

Referring particularly to FIGS. 5, 6 and 8, the construction of the bracket 20 may be understood. The bracket is rigidly connected to wallboard, and optionally to the 2×4 studs 120 or to the 2×6 reinforcements 90 carried behind the wallboard, as seen in FIG. 1.

The bracket 20 provides a generally cylindrical body 21 having one end closed by an end wall 25. An adhesive covering 26, carried by the end wall 25, allows the bracket to be carried by the wallboard 100 or any protective or cosmetic surfacing carried by the wallboard. The adhesive covering may be protected by waxed paper or similar protective film prior to use, thereby preventing the adhesive covering from adhering unintentionally in an undesired manner.

Continuing to refer primarily to FIGS. 5, 6 and 8, a preferred version of the bracket 20 provides three radially directed flanges 22 which allow the bracket to be attached to the wallboard 100, 2×4 studs 120 or 2×6 reinforcements 90 with wood screws, Molly(™) type fasteners or other fasteners. Each flange 22 defines a fastener hole 23 and is strengthened by a reinforcing rib 24 which reduces the chance of the flange breaking off.

Typically, a Molly(™) or similar fasteners are Used, having the characteristic of expansion after insertion. Such a fastener is inserted behind the wallboard, where it expands, making withdrawal impossible. As a result, the fastener is held firmly in place. Alternatively, wood screws may be used to attach the bracket to the 2×4 studs or to the 2×6 reinforcements. This results in a more difficult installation, but in a more rigid connection.

Figure 9:
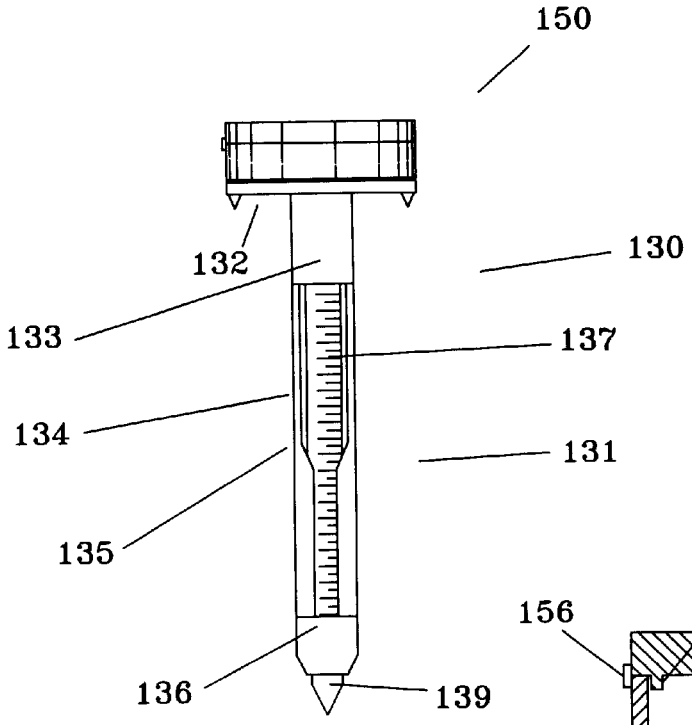
FIG. 9 is a side view of a fastener having a version of the cover of the invention.

A preferred fastener 130 is seen in FIG. 9 with a cover 150 installed over the fastener's head. The operative portion of the fastener includes a Molly(™) or similar device 131, having a spiked flange 132 which grips the flange 22 of the bracket 20. An upper body 133 is sized to extend through the fastener hole 23 and through the wallboard. A slotted body 134 having a bend point 135 is positioned on the far side of the wallboard. A screw 137 having a head 138 and tip 139 is threadedly engaged to the threaded end 136 of the fastener. Rotation of the screw pulls the threaded end 136 to a position adjacent to the wallboard, and bends the slotted body 134 at bend points 135, thereby positioning the slotted body against the inside surface of the drywall.

Figure 10:
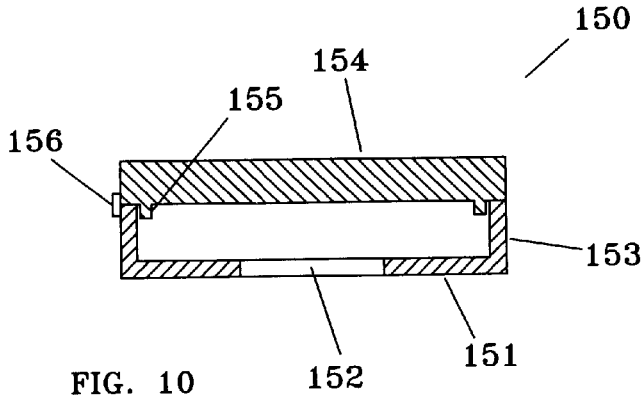
FIG. 10 is a cross-sectional view of the cover in the closed position.
Figure 11:
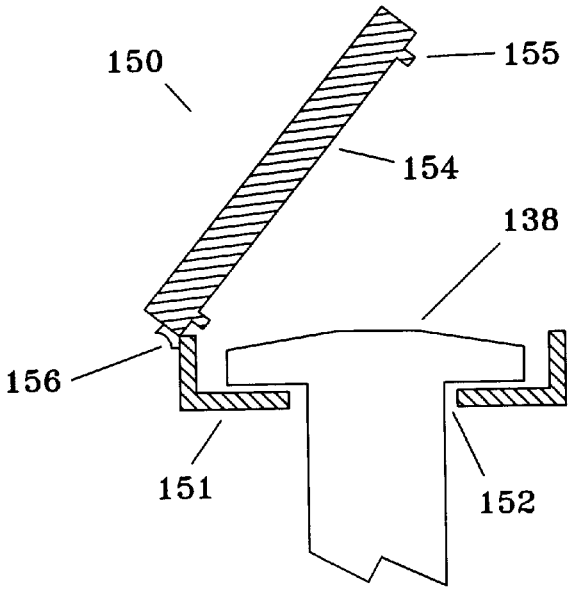
FIG. 11 is a cross-sectional view of the cover in the open position, which allows access to the head of the screw.

As seen in FIGS. 9 through 11, the fastener 130 may include a protective cover 150 used with the Molly(™) or similar device. Such a cover prevents exposure of the fastener to the elements, particularly water. The cover also improves the appearance of the bracket 20 by covering the fasteners and shielding them from view. A preferred cover is typically made of plastic, and is typically shaded to match the color of the bracket.

A preferred protective cover 150 is intended to cover the head 138 of the screw by enclosing it between a base 151 and a lid 154. The base is typically circular, with a hole 152 defined in the center. A sidewall 153 extends from the perimeter of the base and supports a flexible connector 156.

The lid 154 is circular, having a rim 155 that is sized to fit within the sidewall in a frictional manner. The rim of the lid is attached to the connector, preventing its loss when the lid is opened.

FIG. 10, shows the lid in the closed position, with the fastener device removed for clarity. FIG. 11 shows the lid open thereby exposing the head of the screw of the fastener device.

Referring particularly to FIGS. 5 and 8, a short stand-off 40 is seen, having an outside surface 41 that is incrementally smaller in outside diameter than the inside surface of the cylindrical body 21 of the brackets 20. The stand-offs may therefore be inserted with a friction-fit into the brackets, and the connection made permanent with glue or similar adhesive. The length of the stand-offs is typically 2 to 4 inches, but may be varied as desired.

Referring to FIGS. 1, 3, 4, and 5, the construction of the elbow 50 is seen. The elbows are carried by the end brackets 27, and support the first and second ends 61, 62 of the handrail. Each elbow is constructed of first and second cylindrical ends 51, 52 which are oriented perpendicularly to each other, and are separated by a rounded corner 53. As seen particularly in FIG. 5, the inside diameter of the first cylindrical end is sized to frictionally fit over the outside surface 41 of the stand-off 40, and is typically held in place by a coating of glue.

Figure 3:
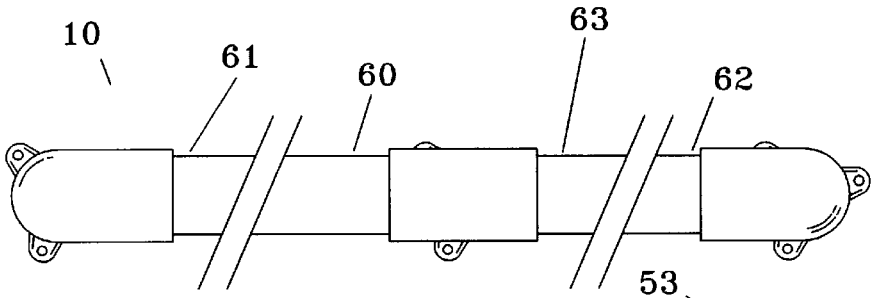
FIG. 3 is a side view of a version of the reinforced handrail having only one center rail support.
Figure 4:
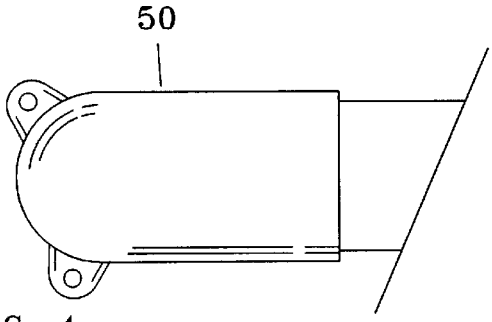
FIG. 4 is an enlarged view of an elbow and a portion of the supporting bracket taken from the perspective of FIG. 3.

Referring particularly to FIGS. 1 and 3, the construction of the handrail 60 is seen. By manually grasping the handrail, the user is able to support himself, particularly where footing is slippery. First and second cylindrical ends 61, 62 of the handrail are frictionally fit within the second cylindrical ends 52 of the elbows 50 carried by the end brackets 27 and glued into place.

The overall length of a preferred version of the handrail 60 is typically between 20 and 48 inches. Where the length of the handrail results in difficulty or expense in shipping or packaging, the handrail may be formed of first and second segments 64, 65. This construction may provide considerable cost savings. To connect the first and second segments rigidly, a stiffener insert 80 is inserted into the adjacent ends of the first and second segments 64, 65.

Figure 2:
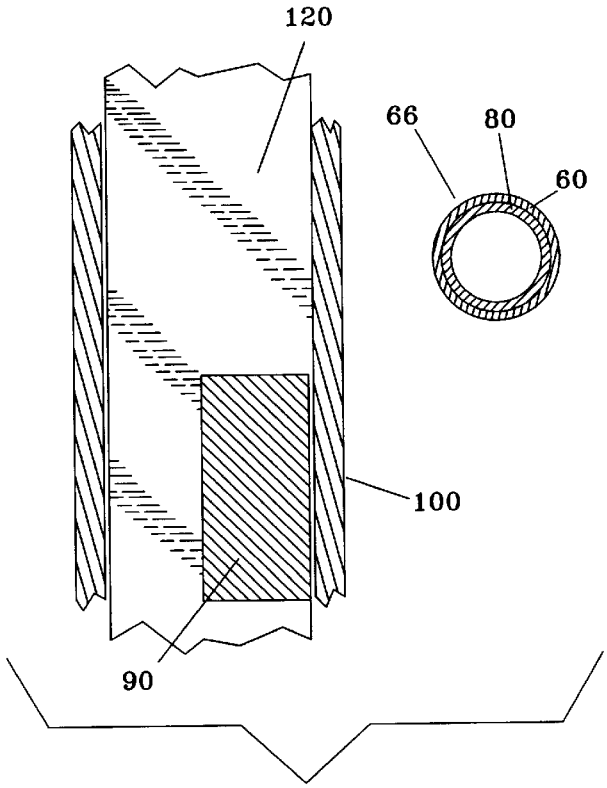
FIG. 2 is an end cross-sectional view of the reinforced handrail of FIG. 1, showing particularly a 2×6 reinforcement carried between 2×4 studs and the stiffener insert carried between segments of the handrail.

Referring to FIGS. 1 and 2, the stiffener insert is sized to frictionally fit into the cylindrical segments 64, 65, where it can be glued, thereby rigidly connecting the segments. The stiffener insert is typically tubing having an outside diameter incrementally less than the inside diameter of the segments 64, 65, and having a length of 4 to 8 inches.

As seen in FIG. 3, a middle portion 63 of the handrail 60 is typically supported by one or more rail supports 70, which provide extra strength and rigidity. The rail supports provide a sliding cylindrical body 71 which has an inside diameter that is incrementally greater than the outside diameter of the handrail 60, allowing it to slide on the outside surface 66 of the handrail.

A perpendicular cylindrical body 72 is sized to allow insertion of the stand-off 40 carried by a center bracket 28.

The rail support is therefore secured to the center bracket 28, and therefore the wallboard and possibly a 2×4 stud or 2×6 reinforcement.

The bracket 20, stand-off 40, elbow 50, handrail 60, rail support 70 and stiffener insert 80 are typically formed of rigid plastic or other suitable material giving it strength, low-cost and resistance to the effects of water.

As seen in FIGS. 1 and 2, horizontally oriented 2×6 reinforcements 90 are carried by adjacent 2×4 studs 120. In a typical application, the length of the 2×6's is selected so that the ends 91 of the 2×6's are separated by the same distance as adjacent 2×4's, allowing the 2×6's to be installed perpendicularly to the 2×4's, as seen in FIGS. 1 and 2.

In a typical application, the wallboard 100 is attached to the 2×4 studs as well as to each 2×6 reinforcement. This results in greatly enhanced wallboard strength in the area of the 2×6's, as well as in greater strength and rigidity of the 2×4 studs.

The previously described versions of the present invention have many advantages, including a primary advantage of providing a novel reinforced handrail that is economically manufactured, easily installed and reliable in use.

Another advantage of the present invention is to provide a novel reinforced handrail having a plurality of brackets that may be installed on tile or wallboard by the use of both adhesive means and wood screws or Molly(™) type fasteners, and wherein the wallboard is reinforced by 2×6 reinforcements carried between the 2×4 studs supporting the wallboard.

A still further advantage of the present invention is to provide a reinforced handrail that provides a stiffener insert that is carried within the handrail to reinforce the handrail when the handrail is made from two segments.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while a preferred version of the invention provides zero, one or two center brackets 28, a greater number could be used, if desired. Similarly, while a preferred version of the invention uses 2×6 reinforcements, 2×4 reinforcements could alternatively be used. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A handrail, supported on wallboard supported by a plurality of 2×4 studs, the handrail comprising:

(A) At least three brackets rigidly connected to the wallboard in a linear array, including two end and at least one center bracket, wherein each bracket comprises:

(a) a cylindrical body having a first end closed by an end wall and an open second end, the end wall providing an outside surface having an adhesive covering adhered to the wallboard;

(b) a plurality of flanges radially directed from the cylindrical body flush with the end wall, and are adjacent to the wallboard, each flange defining a fastener hole and providing two reinforcing ribs; and (c) a fastener, carried by each fastener hole, a head portion of the fastener being enclosed by a cover having a base defining a hole through which the fastener passes and a lid sized for frictional attachment to the base;

(B) a stand-off carried within the cylindrical body of each bracket, extending perpendicularly from the wallboard, having a length of between 2 and 3 inches, wherein the outside diameter is incrementally smaller in diameter than the cylindrical body of the bracket, to which it is attached by fastening means;

(C) first and second elbows, carried by each stand-off supported by the two end brackets, each elbow defining a hollow body having first and second cylindrical ends oriented at right angles to each other, wherein the inside diameter of the first cylindrical end of the elbow is incrementally larger than an outside diameter of the stand-off, to which it is attached by fastening means;

(D) a handrail having first and second ends carried between the second cylindrical ends of the first and second elbows, oriented parallel to the wall, the handrail comprising first and second segments, the segments joined by a stiffener insert;

(E) a rail support attached to a middle portion of the handrail, the rail support having a sliding cylindrical body portion adjustably locatable on the handrail and a perpendicular cylindrical body portion carried by the stand-off carried by the center bracket; and (F) at least one 2×6 reinforcements carried between adjacent 2×4 studs supporting the wallboard, wherein fastening means carried by the each of the plurality of brackets pass through the wallboard and attach to the at least one 2×6 reinforcements.

* * * * *